US005781396A

United States Patent [19]

Fritschi et al.

[11] Patent Number: 5,781,396

[45] Date of Patent: Jul. 14, 1998

[54] ARRANGEMENT FOR THE CONTROL OF AN ELECTROMAGNET

[75] Inventors: Markus Fritschi, Koelliken; Hans-Peter Meili, Seon, both of Switzerland

[73] Assignee: Allen-Bradley Company, Inc., Milwaukee, Wis.

[21] Appl. No.: 588,787

[22] Filed: Jan. 19, 1996

[30] Foreign Application Priority Data

Feb. 9, 1995 [CH] Switzerland ..... 374/95

[51] Int. Cl.[6] ..... H01H 47/04

[52] U.S. Cl. ..... 361/143; 361/210

[58] Field of Search ..... 361/143, 147, 361/159, 166, 167, 187, 154, 191, 210; 324/418, 423; 340/644

[56] References Cited

U.S. PATENT DOCUMENTS

| | | | |
|---|---|---|---|
| 3,737,736 | 6/1973 | Stampfli | 361/154 |
| 3,803,456 | 4/1974 | Myers | 341/159 |
| 4,399,483 | 8/1983 | Phelan | 341/154 |
| 4,608,620 | 8/1986 | Hines | 341/154 |
| 5,510,951 | 4/1996 | Briedis et al. | 361/154 |
| 5,523,684 | 6/1996 | Zimmermann | 361/210 |

FOREIGN PATENT DOCUMENTS

| | | |
|---|---|---|
| 1921232 | 11/1969 | Germany . |
| 5054773 | 3/1993 | Japan . |

*Primary Examiner*—Fritz Fleming

*Attorney, Agent, or Firm*—John M. Miller; John J. Horn

[57] ABSTRACT

The arrangement for the control of an electromagnet is intended for an electromagnet consisting of a Stationary core 7, a pickup coil 1 through which current flows temporarily after the switch is closed, a holding coil 2 through which current flows during the operating state, as well as a moveable armature 8 moving in relation to the core 7. Within a magnetically responsive switching circuit 5, which is connected in series with the pickup coil 1, a coupling sensor 22 is included, consisting of at least one winding which is linked to at least a part of the magnetic field of the electromagnet at least then when the air gap is open. At the instant when the air gap is closed, the voltage spike induced in the sensor coil 22 switches a controllable semiconductor 11, connected in series with the pickup coil 1 into a state of high resistivity via an electronic switching circuit arrangement. Thus, at the moment when the air gap is closed the pickup coil 1 is switched off without the use of any current The magnetically responsive switching circuit 5 utilizes the fact that at the moment when the air gap in an electromagnet is closed, a very steep rate of change in the magnetic flux density occurs. The switching circuit 5 is insensitive to extraneous magnetic fields.

7 Claims, 2 Drawing Sheets

ARRANGEMENT FOR THE CONTROL OF AN ELECTROMAGNET

BACKGROUND OF THE INVENTION

The invention at hand relates to an arrangement designed to control an electromagnet consisting of a stationary core, a pickup coil through which current flows temporarily after the switch has been closed, a holding coil in which current flows during an operating state, and a moving armature the motion of which relative to the core alters the width of an air gap, whereby a switching arrangement, responsive to magnetism and connected in series with the pickup coil, interrupts current supply to the latter when the air gap disappears.

From DE-A1-1921232, we are aware of an arrangement of the type mentioned earlier for the control of an electromagnet. The electromagnet is equipped with a pickup and a holding coil. In order to turn off the pickup coil following the disappearance of the air gap between the core and the armature, a magnetically responsive switching device is utilized, which interrupts current supply to the pickup coil after The electromagnet has been magnetized. The magnetically responsive switching device picks up the stray current caused by the presence of the air gap between the core and the armature. In the switching device, "tongue" type strip contacts of magnetic material are included, at least one of which is pliable and suitable to be attracted to the other strip contact when a magnetic flux surrounds the contacts. This electromagnet exhibits a not negligible switching delay. The delay is caused by the following fact: the holding coil—which is constantly connected to the connection terminals and through which current flows as soon as the electromagnet is turned on—must first build up a stray magnetic field, in order to be able to close the switching circuit responsive to stray magnetic fields, so that a feed voltage is applied to the pickup coil. In addition, the switching device responsive to stray magnetic fields is also very sensitive to extraneous magnetic fields. Such extraneous magnetic fields could originate from electromagnets of adjacent contactors or from neighboring wires through which shortcircuited current may flow. An extraneous field may activate a magnetically responsive switching device, thus resulting in an undesired switching on of the pickup coil, which could in a worse case scenario result in the burning of the pickup coil. Furthermore the magnetically responsive switching device requires a relatively large space, resulting in an enlarged and expensive electromagnet. It should be also noted that contact burnoff results in a relatively short lifespan of the mechanical contacts.

From DE-C2-2128651, we arc further aware of an arrangement to control an electromagnet consisting of a pickup and a holding coil. In this arrangement, switching electronic is utilized to turn off the pickup coil after a predetermined time interval has elapsed. This arrangement fails it least then when, for some reason, the electromagnet is blocked, or when the voltage applied across the coils deviates significantly from the specified value.

The DE-A1-3631133 describes another arrangement to control an electromagnet. This electromagnet consists of one single coil. An electronic switching circuit decreases the amount of current flowing through the only coil when the air gap of the electromagnet is closed in order to control the switching circuit, a Hall-effect sensor is installed in a close proximity to the air gap, and is connected to the switching circuit through a cable. From the instant of switching on until the closing of the air gap, the Hall-effect sensor delivers a voltage. This applied voltage necessary for the control of the switching circuit is strongly dependent from the physical location of the Hall-effect sensor in relation to both the core and the armature. Thus, it is essential that the sensor be accurately positioned In addition, a Hall-effect sensor is strongly responsive to extraneous magnetic fields. Thus, an extraneous magnetic field may change the amount of current flowing through the coil of the electromagnet by either decreasing or increasing it, whereby the holding strength of the electromagnet may be reduced until an undesired separation of the armature from the core occurs. An additional disadvantage of this arrangement is that the switching circuit is relatively power inefficient, because the hold current flowing through the coil must also flow constantly through the switching circuit. Furthermore, the necessary feeding of the Hall-effect sensor has unfavorable effects.

SUMMARY OF THE INVENTION

The objective of the invention at hand is to develop an arrangement for the control of the earlier mentioned type of electromagnet, which exhibits a long lifespan, can be integrated within an electromagnetic device in a space saving manner, functions reliably under any of the operating conditions that may occur, and is largely unresponsive to extraneous magnetic fields, is relatively power efficient and economically advantageous.

This objective is obtained through a sensor coil included in the magnetically responsive switching circuit. The sensor coil consists of at least one winding and is linked at least partially to the magnetic field of the electromagnet at least then when the air gap is open. The voltage spike induced in the sensor coil at the moment of the closing of the air gap is applied across an electronic switching circuit arrangement to shift a controllable semiconductor, connected in series with the pickup coil, To a state of high resistivity. This arrangement does not contain any mechanically movable parts; therefore, exhibits a relatively long lifespan. The arrangement is also space saving, since both the sensor coil and the controllable semiconductor, as well as the additional circuit elements are relatively small in size. The magnetically responsive switching device is also largely insensitive to extraneous magnetic fields, because it does not respond to the stray magnetic field that occurs when the air gap is closet, but responds to the rate of increase in the magnetic flux density of the electromagnet at the instant when the air gap is closed, and to the resulting induced voltage spike in the sensor coil. This magnetically responsive switching device utilizes the fact that at the moment when the air gap of an electromagnet is closed, a very steep rate of change in the magnetic flux density occurs. The resulting voltage spike in the sensor coil is significantly higher than voltages that may be induced by either magnetic fields originating from alternate currents or by other extraneous magnetic fields. This switching device performs adequately under all possible operating conditions, such as too low or too high applied coil voltage, because it becomes responsive only at the instant when the electromagnet is effectively closed After the pickup coil circuit is switched to a state of high resistivity through the energized electromagnet, the power loss through the switching device becomes negligible. The arrangement, which is made up of relatively few circuit components, to control an electromagnet is therefore also economically advantageous.

A sensor coil can be made of at least one winding wound anywhere around the core and/or around the armature. When the air gap between the core and the armature is closed, a voltage is induced in the winding installed anywhere around the core and/or around the armature. This causes a shifting of the controllable semiconductor into a highly resistive state, and thus secures the turning off of the pickup coil.

The sensor coil is arranged favorably in the region of the air gap adjacent to the core and/or armature and is thus linked to the stray field of the electromagnet which is present around the air gap. Hence, the sensor coil, placed in the stray field of the electromagnet within the region of the air gap, delivers an induced voltage spike. This sharp voltage spike effects definitely a state of high resistivity in the controllable semiconductor, thus cutting off the supply of current to the pickup coil. Consequently, only the holding coil is supplied with current and remains energized.

The magnetically responsive switching device is built as a one-piece unit. This approach is especially advantageous, because the one-piece unit, which is to be connected in series with the pickup coil, can be easily installed within the air gap region and contains both sensor coil as well as all the circuit components. Without the need for any positioning efforts, this arrangement secures a high resistivity in the controllable semiconductor. This mimetically responsive switching device is mounted favorably on that flange of the spool body hosting the pickup and holding coils that faces The air gap. The installation of the magnetically responsive switching device in the manner described above presents an especially favorable solution, since the spool flange facing the air gap is as a rule located directly in the air gap region, so that the sensor coil, which is surrounded by the stray field around the air gap, will not require any positioning procedures.

The magnetically responsive switching device can be equipped with a special circuit that enables the setting of an energizing time limit and, in the case of an atypical operating behavior of the armature interrupts the power supply to the pickup coil after a predetermined time interval. This time limiting circuit is intended for example in an instance when an electromagnet is blocked in the open position, so it can limit the energizing time, thereby preventing the burnout of the pickup coil.

In the magnetically responsive switching circuit, a multivibrator directly controlled by the sensor coil can be included to control the semiconductor clement that turns the pickup coil on and off. Through its simple construction, the multivibrator offers a useful solution for the control of the controllable semiconductor.

In the following, an example on how the invention is implemented, is described in derail using the enclosed drawings. The figures show the following:

DETAILED DESCRIPTION OF THE INVENTION

Figure 1:
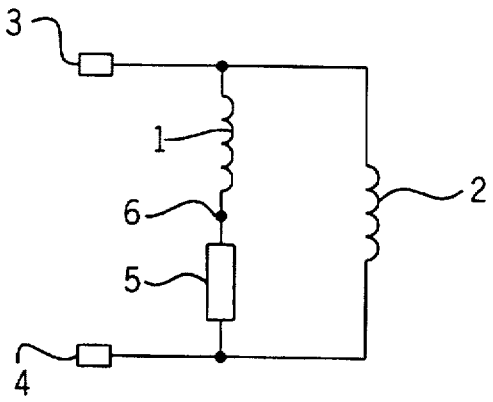
FIG. 1 is a schematic of a holding and pickup coil with a magnetically responsive switching device.
Figure 3:
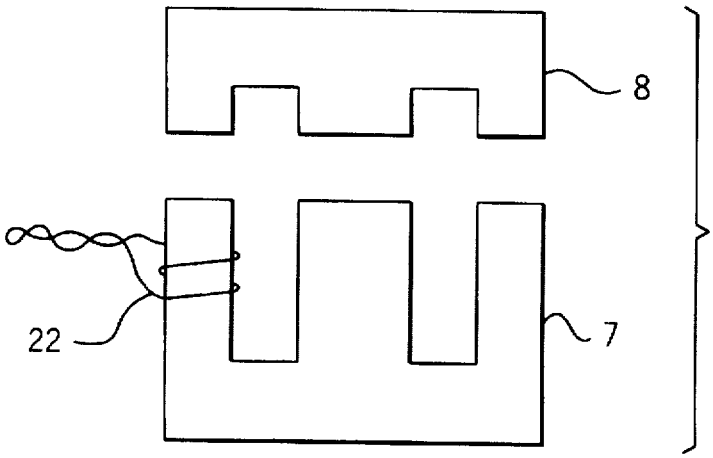
FIG. 3 is a diagram of the sensor coil wound around the iron care.

As shown in FIG. 1, a pickup coil 1 and a holding coil 2 of an electromagnetic switching device—not shown in detail—are connected in parallel across the terminals 3 and 4 of the spool. Between the terminals 4 and 6, a magnetically responsive switching mechanism is connected in series with the pickup coil and controls the current supply to the pickup coil 1. The electromagnet, which is energized through the pickup and holding coils 1,2, has a stationary core 7, FIGS. 3, 4, and 5 and a movable armature 8 moving relative to the core 7 and thus changing the width of the air gap in between.

Figure 2:
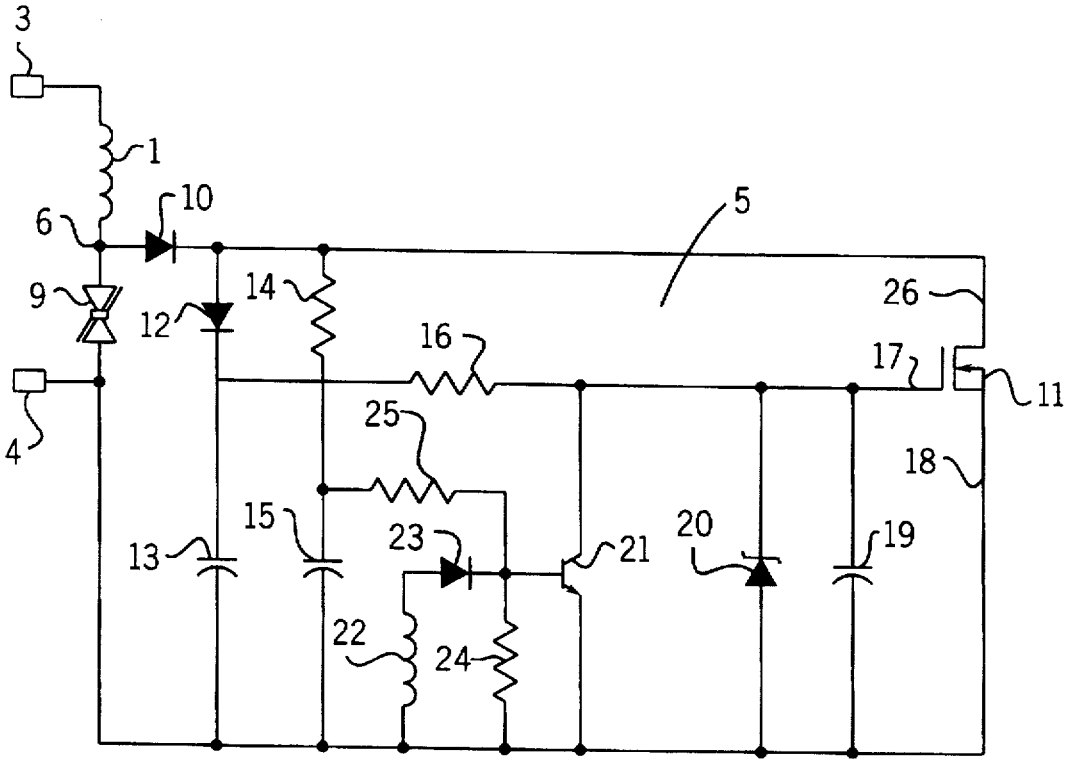
FIG. 2 is a schematic of the magnetically responsive switching circuit together with the pickup coil.

In FIG. 2, the schematic of the magnetically responsive switching circuit 5, shown in FIG. 1 as being connected between the terminals 4 and 6, can be seen. Between the terminals 4 and 6, a transil 9 protects against excess voltage. In order to protect the here shown switching circuit 5 against polarity change of the direct current variant, a diode 10 is inserted next to the input terminal 6. Across the terminals 4 and 6 which are in series with the pickup coil 1, a controllable semiconductor, a MOS-FET 11 in this example; a feed capacitor 13 connected through a diode 12, as well as a blocking capacitor 15 in series with a load resistor 14, are connected in parallel. At the terminal of the feed capacitor 13, and through the start-up load resistor 16, the gave terminal 17 and the source terminal 18 of the MOS-FET 11, a gate-source capacitor 19, a zener diode 20 and an NPN transistor 21 are connected in parallel. A sensor coil 22 is connected to the base of the NPN transistor 21 through a diode 23. The base of the NPN transistor 21 is on the one side connected with the emitter of the transistor through the load resistor 24 of the sensor coil 22, and on the other side connected to the terminal of the blocking capacitor 15 through a resistor 25.

Figure 4:
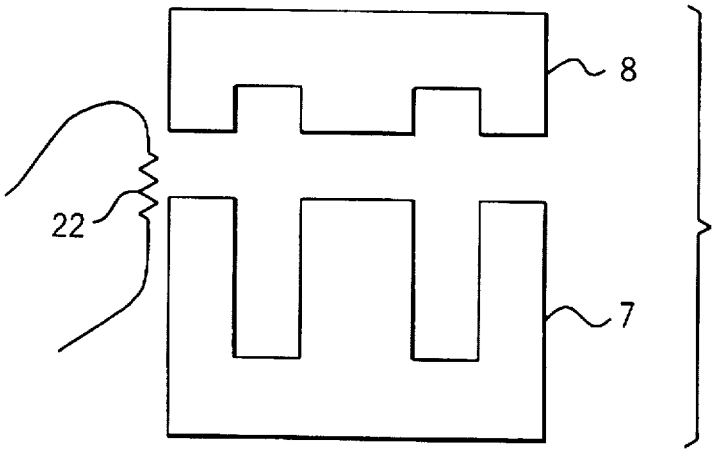
FIG. 4 is a diagram of the sensor coil installed in the air gap region of an electromagnet.

The magnetically responsive switching circuit 5, the schematic of which is shown in FIG. 2, operates as follows: When switching on the contactor, a coil voltage is applied across the coil terminals 3 and 4. The fall coil voltage appears across the open terminals 4 and 6 of the switching circuit 5. The feed capacitor 13, which has a time constant of Ts, is charged through the diode 12 to peak value. The gate-source capacitor 19 with a time constant of Te is charged through the start-up load resistor 16. After at least one time constant the MOS-FET 11 is named on and switched to low resistivity. At this instant, the current flows through the MOS-FET 11 to the pickup coil 1. The contactor magnet is energized; the armature 8 moves towards the core 7, continuously decreasing the air gap width. At the moment when the armature 8 strikes the core 7, the air gap between the two disappears. This results in a very large rate of change in the magnetic flux density both in the core 7 and in the a-mature 8, so that a sensor voltage is induced in a sensor coil 22, (FIG. 3) fitted around the core 7. This sensor coil 22, however, e not be wound around the core 7, it may be mounted as well adjacent to the core 7 and the armature 8 in the air gap region as schematically indicated in FIG. 4 As the stray flux rapidly disappears in the air gap region, a spike-shaped sensor voltage with very steep flanks is induced in the sensor coil 22. The sensor voltage is applied across the diode 23 to the base of the NPN transistor 21, resulting in a base current in the NPN transistor 21. Through the sensor voltage and across the resistor 25, the blocking capacitor 15 is at least partially charged This enables the NPN transistor to remain conductive after the disappearance of the sensor voltage, until an additional charging of the blocking capacitor 15 through the load resistor 14 takes place. Thus, the NPN transistor 21 becomes conductive as soon as the sensor voltage is applied to the base, and discharges the gate-source capacitor 19, whereupon the MOS-FET 11 becomes highly resistive. Hence, the current to the pickup coil 1 is interrupted. The contactor magnet is kept in its magnetized position only through the holding coil 2 which is connected across the spool terminals 3 and 4. As soon as the MOS-FET 11 becomes highly resistive, the blocking capacitor 15 is charged at a time constant Tv across the load resistor 14, following which the NPN transistor 21 is once again supplied with base current through the load resistor 14. In this manner, the NPN transistor 21 remains conductive after the disappearance of the sensor voltage and prevents the MOS-FET from becoming switched to low resistivity. The time constant Tv given by the resistance of the resistor 14 and the capacitance of the blocking capacitor 15 is chosen to be significantly greater than the switching on time constant Te given by the start-up load resistor 16 and the gate-source capacitor 19, so as to prevent the NPN transistor 21 from becoming conductive at the time of the switching on.

Should for any reason the armature 8 of the electromagnetic device be blocked and incapable of moving, so that the turning on of the device becomes impossible, the switching-on phase takes place as described earlier up to the moment when a sensor voltage would have been generated across the sensor coil 22 as a result of the disappearance of the air gap. Because in this case the armature 8 is blocked, the air gap can not be closed in spite of the energized pickup coil 1. In this case, due to leakage currents, the gate-source capacitor 19 is partially discharged with a timeconstant In through the zener diode 20, the NPN transistor 21, and the MOS-FET 11. As soon as the voltage at the gate terminal 17 of the MOS-FET 11 drops below the threshold value, the MOS-FET becomes once again highly resistive, thus interrupting the current supply to the pickup coil 1. Because of the voltage increase at the drain terminal 26 of the MOS-FET 11, the blocking capacitor 15 is charged through the load resistor 14. Whereupon the NPN transistor 21 is supplied with base current through the resistor 25 and becomes conductive. The gate-source capacitor 19 is fully discharged through the NPN transistor 21.

When turning off the contactor, the voltage across the spool terminals 3 and 4 is interrupted. The feed capacitor 13 is discharged through the start-up load resistor 16 and the NPN transistor 21. During this time, the NPN transistor receives the base current from the blocking capacitor 15 through the resistor 25, so that it can remain conductive for the discharge of the feed capacitor 13.

In the example described above, it was referred to an electromagnet which is energized using direct current. However, when energizing an electromagnet through an alternating current, a rectifier can be added favorably before the terminals 4 and 6 of the switching circuit 5. In this arrangement after the turning on of the electromagnet, the sensor coil 22 delivers an induced alternating voltage the frequency of which corresponds to that of the alternating current. However, this induced alternating voltage is significantly smaller than the voltage peak induced through the changing flux density at the closing of the the air gap, so that the alternating voltage induced prior to the closing of the air gap may be considered to be "noise" that is negligible. The base current resulting from the induced alternating voltage is not sufficient enough to tun on the NPN transistor 21.

Figure 5:
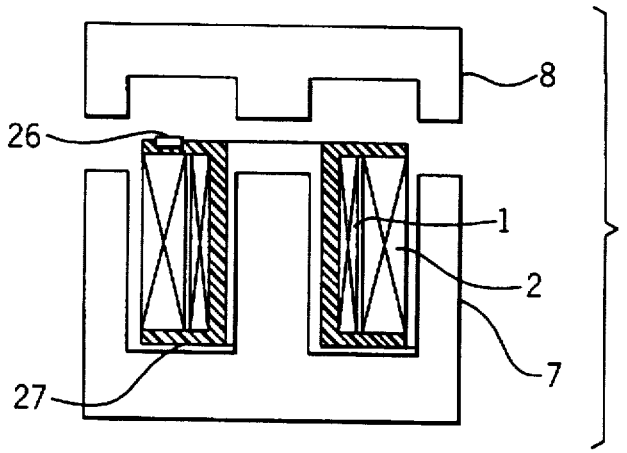
FIG. 5 is a cross sectional diagram of the electromagnet with the windings and the body of the spool.

The magnetically responsive switching circuit 5 is integrated along with the sensor coil 22 favorably in a single unit in the form of a pressed switch plate 26. As shown in FIG. 5, this switching plate 26 is mounted on that flange of the spool body 27 hosting the pickup coil 1 and the holding coil 2 that faces the air gap. The sensor coil 22 integrated onto the switching plate 26 is thus automatically situated within the air gap region and captures there the stray flux.

We claim:

1. A magnetically responsive switching circuit for an electromagnetic device comprising a stationary core, a pickup coil, a holding coil and an armature arranged to move relative to the stationary core to produce an air gap therebetween, the magnetically responsive switching circuit comprising:

a sensor coil arranged to sense a change in magnetic field density in the air gap and produce an output signal: and a semi-conductor element coupled in series with the pickup coil, the semi-conductor element switching to a non-conductive state in response to the output signal.

2. The magnetically responsive switching circuit as set forth in claim 1 wherein the sensor coil comprises at least one winding that is wound around said core.

3. The magnetically responsive switching circuit as set forth in claim 1 wherein the sensor coil is arranged proximal the air gap to sense the change in magnetic field density in the air gap.

4. The magnetically responsive switching circuit as set forth in claim 1 wherein the sensor coil and semi-conductor element are constructed as a one-piece unit.

5. The magnetically responsive switching circuit as set forth in claim 1 wherein the electromagnetic device further comprises a spool and the one piece unit is coupled to the spool.

6. The magnetically responsive switching device as set forth in claim 1 further comprising a time out circuit coupled to the semi-conductor element, the time out circuit switching the semi-conductor element to the non-conductive state after a predetermined time out period in the case of an atypical operating behavior of the armature.

7. The magnetically responsive switching device as set forth in claim 1 further comprising a multivibrator coupled to and controlled by the sensor coil to cause the semiconductor element to switch between a conductive state and the non-conductive state thus switching the pickup coil on and off.

* * * * *